US011333152B2

(12) United States Patent
Kuratani

(10) Patent No.: US 11,333,152 B2
(45) Date of Patent: May 17, 2022

(54) PUMP DEVICE

(71) Applicant: NIDEC SANKYO CORPORATION, Nagano (JP)

(72) Inventor: Hiroki Kuratani, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 122 days.

(21) Appl. No.: 16/720,226

(22) Filed: Dec. 19, 2019

(65) Prior Publication Data

US 2020/0200158 A1 Jun. 25, 2020

(30) Foreign Application Priority Data

Dec. 21, 2018 (JP) ..... JP2018-239871

(51) Int. Cl.
*F04D 13/06* (2006.01)

(52) U.S. Cl.
CPC ..... *F04D 13/0673* (2013.01); *F04D 13/0693* (2013.01); *F04D 13/06* (2013.01)

(58) Field of Classification Search
CPC .. F04D 13/06; F04D 13/0686; F04D 13/0693; H05K 1/117; H05K 1/111; H05K 3/32–3/341; H05K 5/0247; H05K 5/069
USPC ..... 439/83
See application file for complete search history.

(56) References Cited

U.S. PATENT DOCUMENTS

2010/0006554 A1* 1/2010 Inoue ..... F21S 41/148 219/202
2013/0028765 A1* 1/2013 Yokozawa ..... H02K 11/33 417/423.11

FOREIGN PATENT DOCUMENTS

JP 2017216759 A 12/2017

* cited by examiner

*Primary Examiner* — Philip E Stimpert
(74) *Attorney, Agent, or Firm* — Cantor Colburn LLP

(57) ABSTRACT

A pump device may include a motor, an impeller to turn by use of drive power of the motor, and a circuit board for controlling the motor; the pump device being able to become low-profile in an axial direction of a turning center shaft as a turning center of the impeller. In a pump device, there are formed a wall part surrounding a circuit board and a substrate contacting surface, which contacts a lower surface of the circuit board in order to locate circuit board, in a pump case. In the wall part, there is shaped a cutout part that is cut out downward from an upper end surface of the wall part, and meanwhile a leading wire, whose one end side is soldered to the circuit board, passes through the cutout part in such a way as to be drawn out to an outer side of the wall part. In the pump device, a cutout bottom part, which is a lower end part of the cutout part, and the leading wire do not contact each other so as to be detached from each other.

11 Claims, 9 Drawing Sheets

PUMP DEVICE

CROSS REFERENCE TO RELATED APPLICATION

The present application claims priority under 35 U.S.C. § 119 to Japanese Application No. 2018-239871 filed on Dec. 21, 2018, the entire content of which is incorporated herein by reference.

FIELD OF THE INVENTION

The present invention relates to a pump device having a motor and an impeller that turns by use of drive power of the motor.

BACKGROUND

Conventionally, known is a pump device having a motor that includes a rotor and a stator, and an impeller that turns by use of drive power of the motor (for example, refer to Patent Document 1). The pump device described in Patent Document 1 is provided with a circuit board for controlling the motor, and a fixed shaft for supporting the rotor in such a way as to be rotatable. The impeller is fixed to the rotor at one end side in an axial direction of the fixed shaft. Being a rigid substrate shaped so as to be a plane, the circuit board is placed in such a way that a thickness direction of the circuit board is consistent with the axial direction of the fixed shaft. Moreover, the circuit board is fixed to the stator at the other end side in the axial direction of the fixed shaft. On the circuit board, there is mounted a connector. To the connector, there is connected a predetermined cable.

PRIOR ART DOCUMENT

Patent Document

Patent Document 1: Japanese Unexamined Patent Application Publication No. 2017-216759

SUMMARY OF INVENTION

Problem to be Solved

In the pump device described in Patent Document 1, the connector is mounted on the circuit board that is placed in such a way that the axial direction of the fixed shaft is consistent with the thickness direction of the circuit board. Accordingly, in the pump device, a protrusion of the connector from a surface of the circuit board at the other side in the axial direction of the fixed shaft becomes large so that there is a risk that the pump device becomes thick in the axial direction of the fixed shaft.

Therefore, it is an objective of the present invention to provide a pump device; including a motor, an impeller to turn by use of drive power of the motor, and a circuit board for controlling the motor; the pump device being able to become low-profile in an axial direction of a turning center shaft as a turning center of the impeller.

In order to solve the issue described above, a pump device according to at least an embodiment of the present invention may include: a motor having a rotor and a stator; an impeller that is fixed to the rotor, and turns by use of drive power of the motor; a circuit board for controlling the motor; and a leading wire whose one end side is soldered to the circuit board, and the leading wire being drawn out of the circuit board; wherein, inside a pump case in which the rotor, the stator, the circuit board and the impeller are housed, there is formed a pump chamber through which liquid sucked from a suction port passes toward a discharge port; if one side in an axial direction of a turning center shaft, as a turning center of the rotor and the impeller, is represented as a first direction, and an opposite direction to the first direction is represented as a second direction; the impeller is fixed to the rotor at a side of the first direction, and the circuit board is a rigid substrate, and placed at a side of the second direction of the stator; a thickness direction of the circuit board is consistent with the axial direction of the turning center shaft; in the pump case, there are formed a wall part surrounding the circuit board, and a substrate contacting surface contacting a surface of the circuit board at a side of the first direction in order to locate the circuit board in the axial direction of the turning center shaft; in the wall part, there is shaped a cutout part in which a part of the leading wire is placed, the cutout part being cut out in the wall part from an end surface at a side of the second direction toward a side of the first direction; the leading wire passes through the cutout part in such a way as to be drawn out to an outer side of the wall part; and a cutout bottom part as an end part of the cutout part at a side of the first direction, and the leading wire do not contact each other so as to be detached from each other.

In the pump device according to at least an embodiment of the present invention, the leading wire, whose one end side is soldered to the circuit board, is drawn out of the circuit board. Moreover, according to at least an embodiment of the present invention; in the wall part of the pump case, surrounding the circuit board, there is shaped the cutout part that is cut out in the wall part from the end surface at the side of the second direction toward the side of the first direction; the leading wire passes through the cutout part in such a way as to be drawn out to the outer side of the wall part. Accordingly, in comparison to a case where a connector is mounted on the circuit board, it becomes possible according to at least an embodiment of the present invention to control an amount of the leading wire protruding out of a surface of the circuit board at a side of the second direction, the circuit board being placed at a side of the second direction of the stator. Therefore, in comparison to the case where the connector is mounted on the circuit board, it becomes possible according to at least an embodiment of the present invention to make the pump device low-profile in the axial direction of the turning center shaft.

Furthermore, according to at least an embodiment of the present invention, the cutout bottom part as the end part of the cutout part at the side of the first direction, and the leading wire do not contact each other so as to be detached from each other. In other words, the cutout bottom part and the leading wire are so placed as to have a space between them. Therefore, according to at least an embodiment of the present invention; at a time when the circuit board, to which the leading wire is soldered, is fixed to the pump case and the like, in a situation where the circuit board is pressed against the substrate contacting surface from a side of the second direction in order to locate the circuit board, it becomes possible to prevent an excessive force from acting on a soldered part, where the leading wire is soldered to the circuit board. Therefore, according to at least an embodiment of the present invention; even at the time when the circuit board, to which the leading wire is soldered, is fixed to the pump case and the like, it becomes possible to protect the soldered part against being removed from the circuit board, owing to fixing work of the circuit board.

According to at least an embodiment of the present invention, for example; a protrusion is formed in the pump case so as to protrude from the substrate contacting surface to a side of the second direction; in the circuit board, there is formed a through hole through which the protrusion is inserted; and at a tip part of the protrusion, there is formed a deposit-welded part that prevents the circuit board from coming off to the side of the second direction. In other words, for example, the circuit board is fixed to the pump case, by way of deposit-welding, in a situation where the circuit board is pressed against the substrate contacting surface, from the side of the second direction, in order to locate the circuit board. In this case, at a time when the circuit board, to which the leading wire is soldered, is pressed against the substrate contacting surface, and fixed to the pump case by way of deposit-welding, it becomes possible to prevent an excessive force from acting on the soldered part. Therefore, even at the time when the circuit board, to which the leading wire is soldered, is pressed against the substrate contacting surface, and fixed to the pump case by way of deposit-welding, it becomes possible to protect the soldered part against being removed from the circuit board, owing to fixing work of the circuit board.

In at least an embodiment of the present invention, it is preferable that the rotor and the impeller are placed inside the pump chamber; the stator and the circuit board are placed outside the pump chamber; an area inside the pump case, where the stator and the circuit board are placed outside the pump chamber, is filled with a potting compound; and at least, a part between the cutout bottom part and the leading wire, is filled with an adhesive material. According to this configuration, even though the cutout bottom part and the leading wire do not contact each other so as to be detached from each other, it becomes possible by use of the adhesive material filled at the part between the cutout bottom part and the leading wire, to prevent the potting compound from escaping through the part between the cutout bottom part and the leading wire.

In at least an embodiment of the present invention, it is preferable that an entire area of the cutout part is filled with the adhesive material in such a way as to surround the leading wire. According to this configuration, even though the cutout part is shaped in the wall part, it becomes possible to prevent the potting compound from escaping through the cutout part.

In at least an embodiment of the present invention, it is preferable that the cutout bottom part is located at a side of the second direction, in comparison to the substrate contacting surface. According to this configuration, it is possible to prevent a clearance between the cutout bottom part and the leading wire from unnecessarily becoming wide. Therefore, the amount of adhesive material, to be filled at the clearance between the cutout bottom part and the leading wire, can be reduced so that it becomes possible to shorten a curing time of the adhesive material, filled at the clearance between the cutout bottom part and the leading wire. Furthermore, if the clearance between the cutout bottom part and the leading wire unnecessarily becomes wide, the adhesive material applied between the cutout bottom part and the leading wire is likely to escape through the clearance between the cutout bottom part and the leading wire. Nevertheless, according to the present embodiment, it is possible to prevent the clearance between the cutout bottom part and the leading wire from unnecessarily becoming wide so that the adhesive material applied between the cutout bottom part and the leading wire is unlikely to escape through the clearance between the cutout bottom part and the leading wire.

In at least an embodiment of the present invention, it is preferable that the leading wire is fixed by use of adhesive, to an end part of the circuit board. According to this configuration, it becomes possible to prevent an excessive force from acting on the soldered part, where the leading wire is soldered to the circuit board.

In at least an embodiment of the present invention, it is preferable that the leading wire includes a plurality of cable cores made of a conductive material, and a sheath part made of an insulative material, for individually covering around each of the plurality of cable cores; a tip part of each of the plurality of cable cores is an exposed part that exposes itself by way of protruding out of a tip of the sheath part; in the circuit board, there is formed a second cutout part that is cut out toward an inner side of the circuit board from an end surface of the circuit board; in the vicinity of the second cutout part, on a surface of the circuit board at a side of the second direction, there is formed a solder land where the exposed part is soldered so as to be fixed; and at the second cutout part, there is located a tip part of the sheath part including the tip of the sheath part. According to this configuration, it becomes possible to further control the amount of the leading wire protruding out of the surface of the circuit board at the side of the second direction, the circuit board being placed at the side of the second direction of the stator. Therefore, it becomes possible to further make the pump device low-profile in the axial direction of the turning center shaft.

In at least an embodiment of the present invention; if a part in the wall part, at which the cutout part is shaped, is dealt with as a cutout shaping part, and a direction perpendicular to the axial direction of the turning center shaft as well as a thickness direction of the cutout shaping part is represented as a third direction, a shape of the cutout part in a view from the thickness direction of the cutout shaping part is, for example, either a U-shape, in which a width in the third direction is constant in an extent from an end part at a side of the second direction of the cutout shaping part to a predetermined position in the axial direction of the turning center shaft, or a semi-conical form, in which a width in the third direction gradually becomes narrower as a width position comes from the end part at the side of the second direction of the cutout shaping part toward the side of the first direction.

Incidentally; if the shape of the cutout part in the view from the thickness direction of the cutout shaping part is a semi-conical form; in comparison to a case where the shape of the cutout part in the view from the thickness direction of the cutout shaping part is a U-shape, the amount of adhesive material, to be filled at the clearance between the cutout bottom part and the leading wire, can be reduced so that it becomes possible to shorten a curing time of the adhesive material, filled at the clearance between the cutout bottom part and the leading wire.

In at least an embodiment of the present invention, it is preferable that, at an edge of the cutout part of an inner side surface of the wall part, there is shaped a sloped surface that is sloped so as to be further away from the cutout part as a slope position comes toward an inner side of the wall part. According to this configuration, at least, the adhesive material, filled at the clearance between the cutout bottom part and the leading wire, is unlikely to escape into an outer side of the wall part.

Moreover, in this case; it is preferable that, at an edge of the cutout part of an outer side surface of the wall part, there is shaped a second sloped surface that is sloped so as to be further away from the cutout part as a slope position comes toward the outer side of the wall part. According to this configuration, at least the adhesive material filled in the space between the cutout bottom part and the leading wire is unlikely to escape from the cutout part, owing to surface tension. Therefore, at least the adhesive material filled in the space between the cutout bottom part and the leading wire is unlikely to escape into the outer side of the wall part.

In at least an embodiment of the present invention, it is preferable that, at the cutout part, there is shaped a concave part where a part of the adhesive material is held. According to this configuration, at least the adhesive material filled in the space between the cutout bottom part and the leading wire is unlikely to escape from the cutout part.

Advantageous Effect of the Invention

As described above, in the pump device, provided with the motor, the impeller to turn by use of drive power of the motor, and the circuit board for controlling the motor; according to the present invention, the pump device can become low-profile in the axial direction of the turning center shaft as the turning center of the impeller. Furthermore, according to the present invention, even at a time when the circuit board, to which a leading wire is soldered, is fixed to the pump case and the like, it becomes possible to protect the soldered part against being removed from the circuit board, owing to the fixing work of the circuit board.

DESCRIPTION OF THE PREFERRED EMBODIMENTS

With reference to the drawings, an embodiment of the present invention is explained below.

(General Structure of Pump Device)

Figure 1:
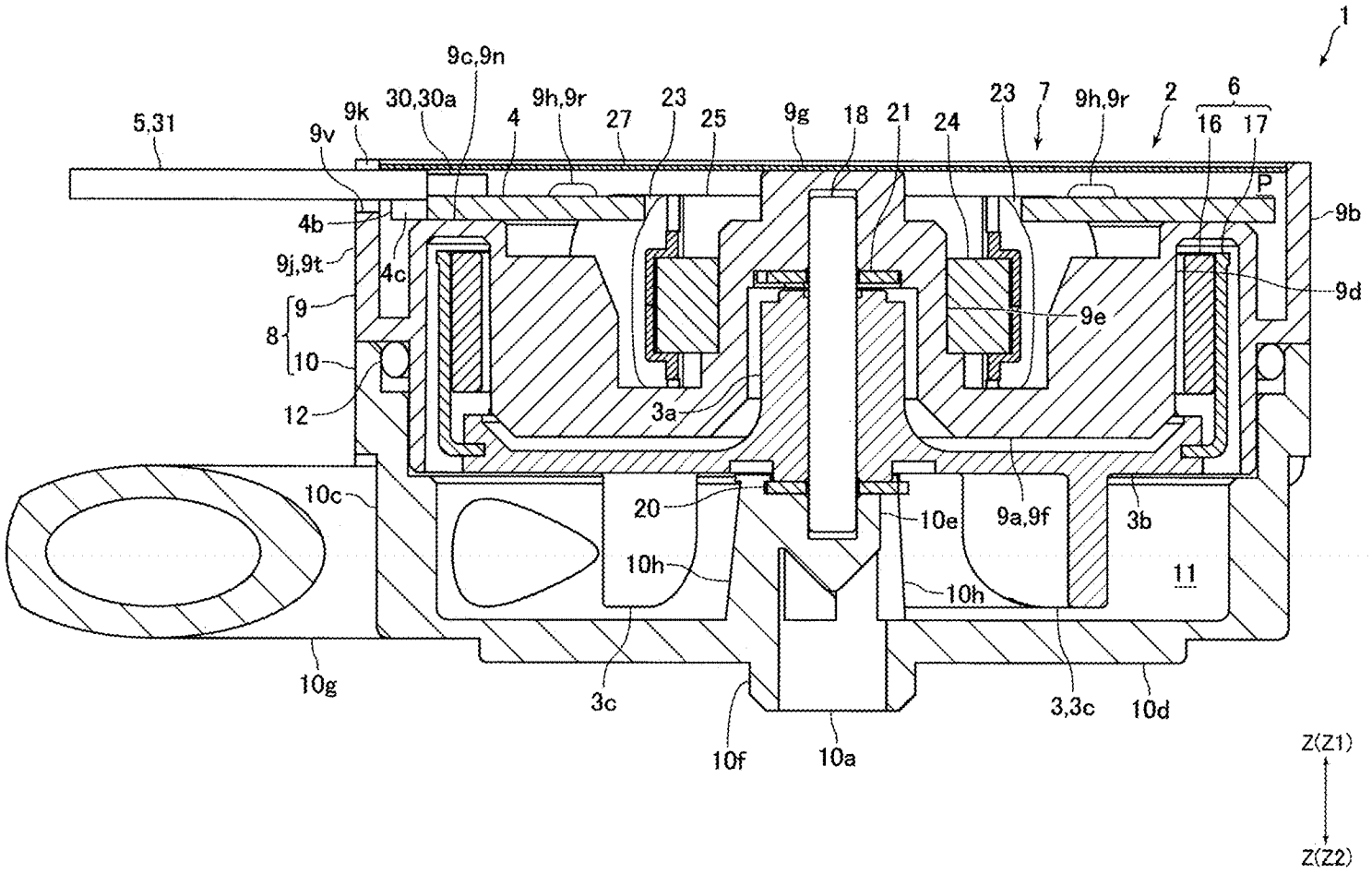
FIG. 1 is a cross-sectional view of a pump device according to an embodiment of the present invention.
Figure 2:
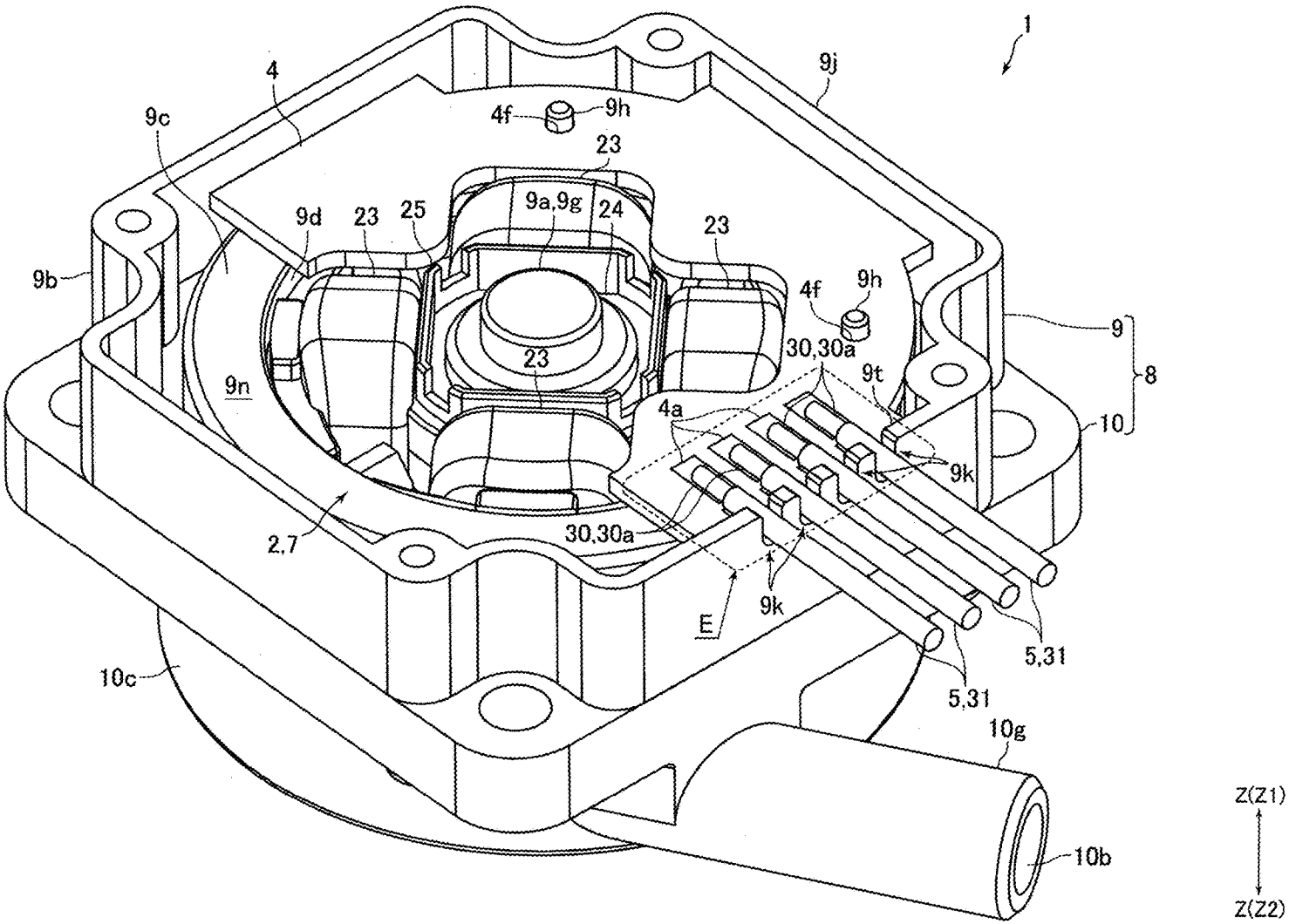
FIG. 2 is a perspective view of the pump device shown in FIG. 1, illustrating a situation in which a cover is removed from the pump device.

FIG. 1 is a cross-sectional view of a pump device 1 according to an embodiment of the present invention. FIG. 2 is a perspective view of the pump device 1 shown in FIG. 1, illustrating a situation in which a cover 27 is removed from the pump device 1. In the following explanation, a Z-direction in FIG. 1 represents a vertical direction. Moreover, a side of a Z1-direction in FIG. 1, i.e., being one side in the vertical direction, is referred to as an "upper" side; and meanwhile being an opposite side to the side mentioned above, a side of a Z2-direction in FIG. 1 is referred to as a "lower" side.

The pump device 1 according to the present invention is a centrifugal pump of a type so-called a canned pump (a canned motor pump). The pump device 1 includes a motor 2, an impeller 3 that turns by use of drive power of the motor 2, a circuit board 4 for controlling the motor 2, and a leading wire 5 drawn out of the circuit board 4. The pump device 1 of the present embodiment has four leading wires 5. The motor 2 is a DC brush-less motor. The motor 2 includes a rotor 6 and a stator 7. The impeller 3, the circuit board 4, the rotor 6, and the stator 7 are housed in a pump case 8. The pump case 8 includes a motor case 9 that makes up a part of the motor 2, and a case body 10 fixed at a bottom end side of the motor case 9.

In the case body 10, there are formed a suction port 10*a* for sucking liquid, such as water and the like, and a discharge port 10*b* for discharging the liquid. Inside the pump case 8, there is formed a pump chamber 11 through which the liquid sucked from the suction port 10*a* passes toward the discharge port 10*b*. The pump chamber 11 is demarcated with the motor case 9 and the case body 10. At a connection part between the motor case 9 and the case body 10, there is placed a sealing component 12, being annular, for securing a tight seal of the pump chamber 11. The sealing component 12 is an O-ring. The motor case 9 and the case body 10 are fixed to each other by use of a plurality of screws.

The rotor 6 includes a driving magnet 16, shaped so as to be cylindrical, and a magnet holding member 17, being cylindrical, to which the driving magnet 16 is fixed. The magnet holding member 17, shaped so as to be cylindrical, is placed in such a way that an axial direction of the magnet holding member 17 is consistent with the vertical direction. The driving magnet 16 is fixed to an inner circumferential surface of the magnet holding member 17. At an inner circumferential surface of the driving magnet 16, there are alternately magnetized an N-pole and an S-pole in a circumferential direction. The magnet holding member 17 is formed of a soft magnetic material. At a bottom end side of the magnet holding member 17, the impeller 3 is fixed. In other words, the impeller 3 is fixed to a bottom end side of the rotor 6.

The impeller 3 and the rotor 6 are placed inside the pump chamber 11. Meanwhile, the impeller 3 and the rotor 6 are supported by a fixed shaft 18 in such a way as to be rotatable. The impeller 3 and the rotor 6 turn around the fixed shaft 18, as a rotation center. The fixed shaft 18 in the present embodiment is a rotation center axis that works as the rotation center of the impeller 3 and the rotor 6. The fixed shaft 18 is placed in such a way that an axial direction of the fixed shaft 18 is consistent with the vertical direction. In other words, the vertical direction (the Z-direction) is the axial direction of the fixed shaft 18. Moreover, a downward direction (the Z2-direction) in the present embodiment is a first direction, being one side in the axial direction of the fixed shaft 18, and meanwhile an upward direction (the Z1-direction) is a second direction, being an opposite direction to the first direction.

The impeller 3 is made of a resin material. The impeller 3 includes: a bearing part 3*a* through which the fixed shaft 18 is inserted; an impeller shaping part 3*b*, being disk-like, which is fixed to a lower end of the magnet holding member 17 so as to cover in the lower end of the magnet holding member 17; and a plurality of impeller parts 3*c* that protrude toward a lower side from a lower surface of the impeller shaping part 3*b*. The bearing part 3*a* is cylindrically formed, and the fixed shaft 18 is inserted at an inner circumferential side of the bearing part 3*a*. Moreover, the bearing part 3*a* leads to a center of the impeller shaping part 3*b*. To the lower end of the magnet holding member 17, there is fixed an outer circumferential part of the impeller shaping part 3*b*.

A lower end part of the fixed shaft 18 is held by the case body 10, and meanwhile an upper end part of the fixed shaft 18 is held by the motor case 9. Between the case body 10 and the bearing part 3*a*, there is placed a thrust bearing part 20; and meanwhile between the motor case 9 and the bearing part 3*a*, there is placed a thrust bearing part 21. The thrust bearing part 20 and the thrust bearing part 21 are individually a slide bearing element formed so as to be plate-like. At least one of a part between the thrust bearing part 20 and the bearing part 3*a*, and a part between the thrust bearing part 21 and the bearing part 3*a*, has a clearance (thrust play) formed there.

The stator 7 is placed inside the driving magnet 16. In other words, the motor 2 in the present embodiment is a motor of an outer-rotor type, in which the driving magnet 16 constructing a part of the rotor 6 is placed at an outer circumferential side of the stator 7. Meanwhile, the stator 7 is placed at an outer circumferential side of the fixed shaft 18 and the bearing part 3*a*. Moreover, the stator 7 is positioned outside the pump chamber 11. The stator 7 includes a plurality of driving coils 23 and a stator core 24. The driving coils 23 are wound around the stator core 24, by the intermediary of an insulator 25 made of an insulation material, such as a resin material and the like. Moreover, the driving coils 23 are electrically connected to the circuit board 4.

The circuit board 4 is a rigid substrate, such as a glass-epoxy substrate and the like, and shaped so as to be plate-like. The circuit board 4 is placed in such a way that a thickness direction of the circuit board 4 is consistent with the vertical direction. In other words, the thickness direction of the circuit board 4 is consistent with the axial direction of the fixed shaft 18. The circuit board 4 is placed at an upper end side of the stator 7, being located outside the pump chamber 11. The circuit board 4 and the stator 7 are housed in the motor case 9.

The motor case 9 is made of a resin material. Moreover, the motor case 9 includes a bulkhead 9*a*, which is placed between the impeller 3 & the rotor 6 and the stator 7 so as to separate the impeller 3 & the rotor 6 from the stator 7. The bulkhead 9*a* demarcates a part of the pump chamber 11, and performs a function to prevent the liquid inside the pump chamber 11 from flowing into a position where the stator 7 and the circuit board 4 are located.

Meanwhile, the bulkhead 9*a* includes: an outer bulkhead part 9*d*, being cylindrical, which is placed at a location of an outer circumferential side of the stator 7 and an inner circumferential side of the driving magnet 16; an inner bulkhead part 9*e*, being cylindrical, which is placed at an inner circumferential side of the stator 7; an annular bulkhead part 9*f*, being annular, which connects a lower end of the outer bulkhead part 9*d* and a lower end of the inner bulkhead part 9*e*; and a bottom part 9*g* to cover in an upper end of the inner bulkhead part 9*e*. The bottom part 9*g* serves as a shaft holding part to hold the upper end part of the fixed shaft 18. The bottom part 9*g* holds the upper end part of the fixed shaft 18 as well as the thrust bearing part 21.

Meanwhile, the motor case 9 includes: an outer circumferential sleeve part 9*b*, being cylindrical, which is placed at an outer circumferential side of the bulkhead 9*a*; a connecting part 9*c* that connects the bulkhead 9*a* and the outer circumferential sleeve part 9*b*. The case body 10 is fixed to a lower end side of the outer circumferential sleeve part 9*b*. The connecting part 9*c* is annularly shaped, and so formed as to be plate-like and perpendicular to the vertical direction. The connecting part 9*c* extends from an upper end from the outer bulkhead part 9*d*, outward in a radial direction of the rotor 6, in such a way as to connect an upper end part of the outer circumferential sleeve part 9*b* and the upper end of the outer bulkhead part 9*d*. Meanwhile, an upper surface of the connecting part 9*c* is a plane perpendicular to the vertical direction. Moreover, the upper surface of the connecting part 9*c* is placed at a side lower than an upper end surface of the outer circumferential sleeve part 9*b*.

Meanwhile, the upper surface of the connecting part 9*c* serves as a substrate contacting surface 9*n* that contacts a lower surface of the circuit board 4 so as to locate the circuit board 4 in the vertical direction. In other words, there is formed the substrate contacting surface 9*n*, which contacts the lower surface of the circuit board 4 in order to locate circuit board 4 in the vertical direction, in the pump case 8. On an upper surface of the substrate contacting surface 9*n*, there are formed a plurality of protrusions 9*h* in order to locate the circuit board 4 in the radial direction of the rotor 6 and to fix the circuit board 4. For example, two protrusions 9*h* are formed on the upper surface of the substrate contacting surface 9*n*. The protrusions 9*h* protrude upward from the substrate contacting surface 9*n*. In other words, there are formed the protrusions 9*h* protruding upward from the substrate contacting surface 9*n*, in the pump case 8.

In the circuit board 4, there is formed a through hole 4*f* (refer to FIG. 2) through which the protrusions 9*h* are individually inserted. The through hole 4*f* passes through the circuit board 4 in the vertical direction. The circuit board 4 is fixed to the pump case 8, by way of melting an upper end part of the protrusions 9*h* for deposit-welding, in a situation where the circuit board 4, with the protrusions 9*h* being individually inserted through the through hole 4*f*, is pressed against the substrate contacting surface 9*n*. In other words, the circuit board 4 is fixed to the motor case 9 by way of thermal deposit-welding. At a tip part (the upper end part) of the protrusions 9*h*, there is formed a deposit-welded part 9*r* (refer to FIG. 1) that prevents the circuit board 4 from coming off upward. Incidentally, FIG. 2 illustrates a situation before melting the upper end part of the protrusions 9*h* (namely, before deposit-welding at the part).

As described above, the circuit board 4 and the stator 7 are housed in the motor case 9. The stator 7 is housed between the outer bulkhead part 9*d* and the inner bulkhead part 9*e*, in the radial direction of the rotor 6; and placed at an upper side of the annular bulkhead part 9*f*. The circuit board 4 is stored in the motor case 9, in a situation of contacting the substrate contacting surface 9*n*. A part of the outer circumferential sleeve part 9*b* serves as a wall part 9*j* that surrounds the circuit board 4. In other words, there is formed the wall part 9*j* surrounding the circuit board 4, in the pump case 8. The wall part 9*j* is almost shaped so as to be a rectangular sleeve. An upper end surface of the wall part 9*j* serves as the upper end surface of the outer circumferential sleeve part 9*b*. Moreover, the upper end surface of the wall part 9*j* serves as an upper end surface of the motor case 9.

An opening part formed at an upper end of the wall part 9*j* is covered with the cover 27. Being shaped like a thin flat plate, the cover 27 is placed in such a way that a thickness direction of the cover 27 is consistent with the vertical direction. The cover 27 is placed at an upper side of the circuit board 4. Moreover, the cover 27 is placed at an upper side of the bottom part 9*g*. An end surface (outer circumferential surface) of the cover 27 is in contact with an inner side surface of the wall part 9*j*.

A space demarked by the motor case 9 and the cover 27 (i.e., a space demarked by the bulkhead 9*a*, the outer circumferential sleeve part 9*b*, the connecting part 9*c*, and the cover 27) is filled with a potting compound 'P.' In other words, an area inside the pump case 8, where the circuit board 4 and the stator 7 are placed outside the pump chamber 11, is filled with the potting compound 'P' so that the circuit board 4 and the stator 7 are covered with the potting compound 'P.' The potting compound 'P' is, for example, a urethane resin material. The potting compound 'P' performs a function to secure an insulation property, a waterproof property, and a thermal radiation property of the circuit board 4 and the stator 7. Meanwhile, the potting compound 'P' is injected from an upper side of the motor case 9.

The case body 10 is made of a resin material. The case body 10 is shaped like a sleeve having a bottom, which includes a cylindrical part 10*c* being cylindrically formed, and a bottom part 10*d* covering one end of the cylindrical part 10*c*. An axial direction of the cylindrical part 10*c*, being cylindrically formed, is consistent with the vertical direction. The bottom part 10*d* covers a lower end of the cylindrical part 10*c*. An inner circumferential side of the cylindrical part 10*c* and an upper side of the bottom part 10*d* make up the pump chamber 11. In the case body 10, there are formed; a shaft holding part 10*e* to hold the lower end part of the fixed shaft 18; a suction port shaping part 10*f*, being cylindrical, at a top of which the suction port 10*a* is shaped; and a discharge port shaping part 10*g*, being cylindrical, at a top of which the discharge port 10*b* is shaped.

The shaft holding part 10*e* is connected to a center part of the bottom part 10*d*, by the intermediary of a connecting part 10*h*. The shaft holding part 10*e* holds the lower end part of the fixed shaft 18, as well as the thrust bearing part 20. The suction port shaping part 10*f* protrudes downward from a center of the bottom part 10*d*. The discharge port shaping part 10*g* protrudes toward an outer circumferential side from an outer circumferential surface of the cylindrical part 10*c*.

(Leading Wire and Structure of Peripheral Part of the Leading Wire)

Figure 3:
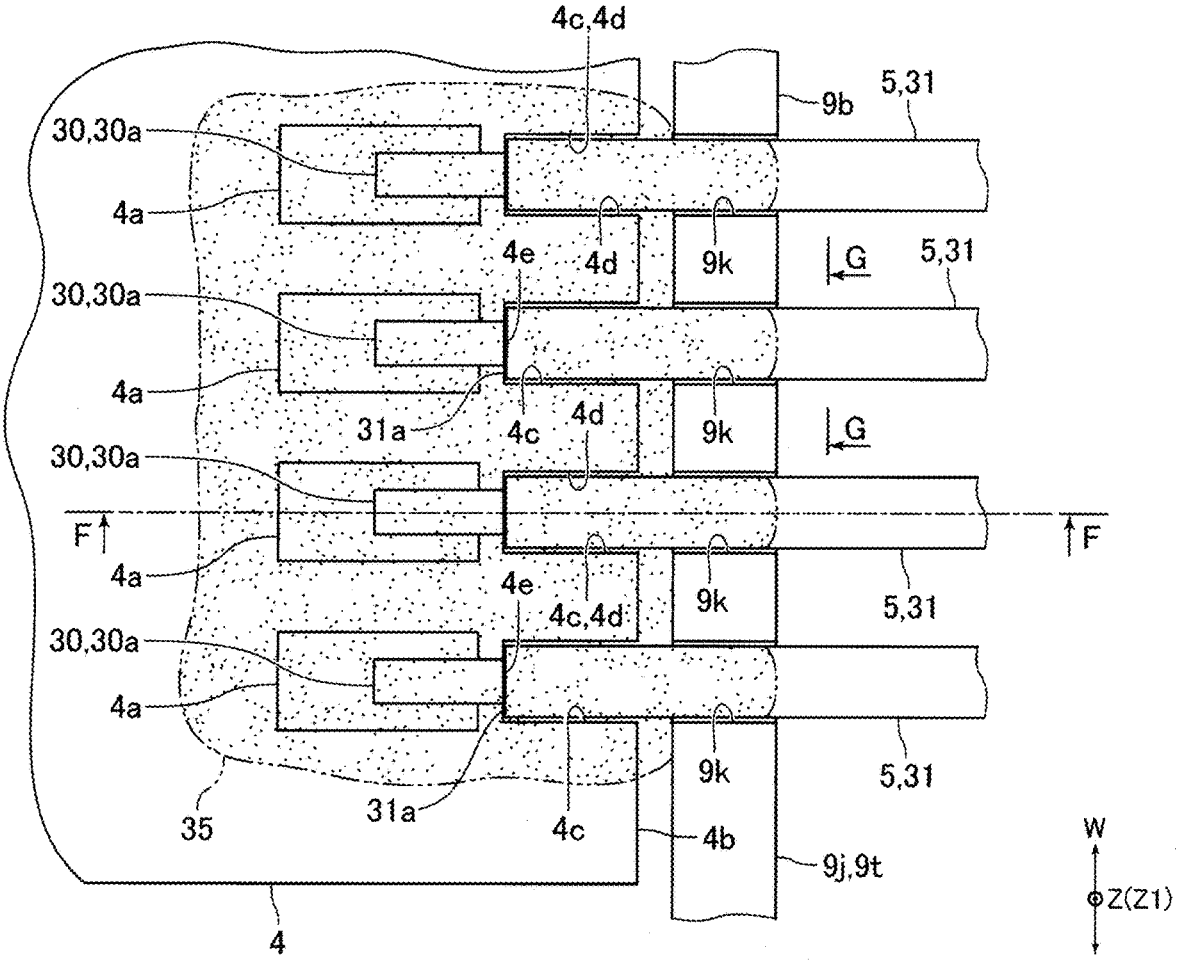
FIG. 3 is a plan view of a section 'E' shown in FIG. 2.
Figure 4:
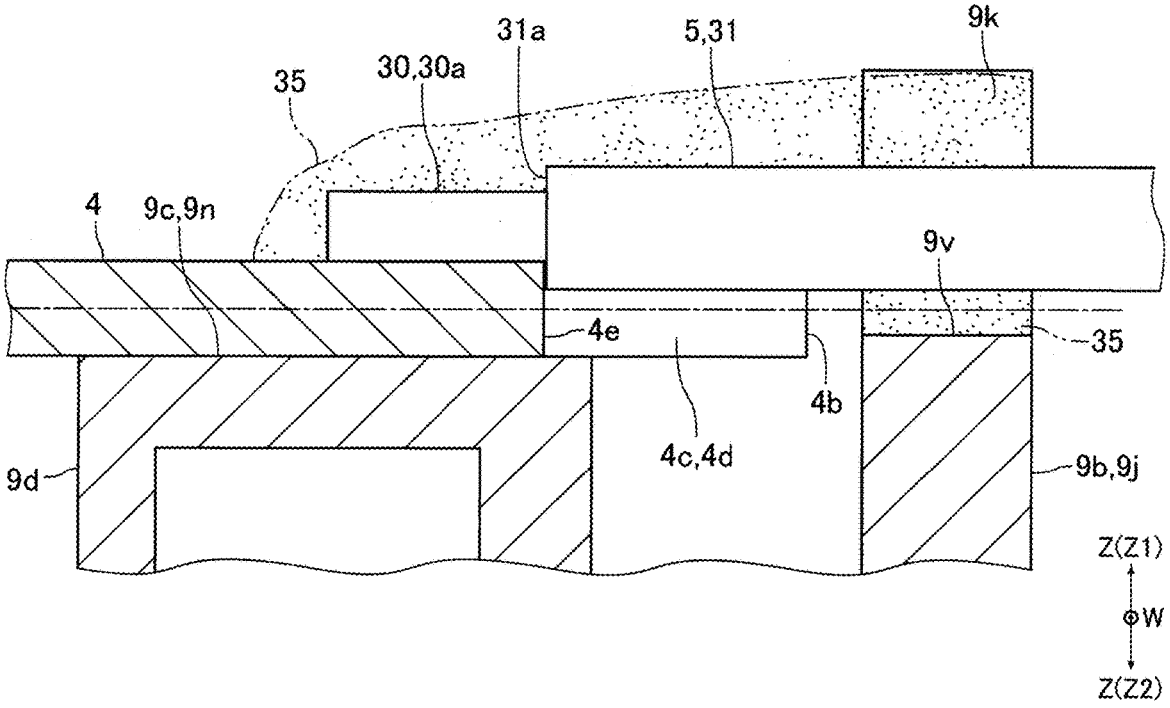
FIG. 4 is a cross-sectional view taken along a line F-F shown in FIG. 3.
Figure 5:
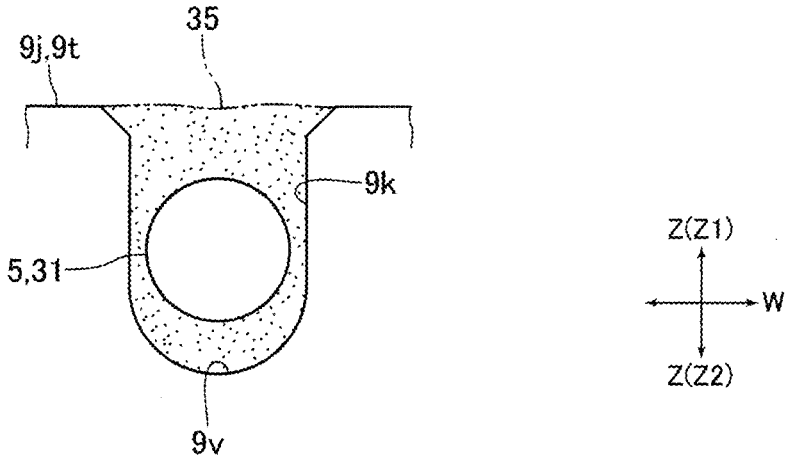
FIG. 5 is a diagram showing an illustration of a leading wire and a cutout part, viewed from a direction G-G shown in FIG. 3.

FIG. 3 is a plan view of a section 'E' shown in FIG. 2. FIG. 4 is a cross-sectional view taken along a line F-F shown in FIG. 3. FIG. 5 is a diagram showing an illustration of the leading wire 5 and a cutout part 9*k*, viewed from a direction G-G shown in FIG. 3.

The leading wires 5 include a plurality of cable cores 30 made of a conductive material, and sheath parts 31 made of an insulative material, for individually covering around each of the plurality of cable cores 30. Tip parts of the plurality of cable cores 30 are exposed parts 30*a* that individually expose themselves by way of protruding out of tips 31*a* of the sheath parts 31. On an upper surface of the circuit board 4, there is formed a solder land 4*a* where the exposed parts 30*a* are soldered so as to be fixed. In other words, one end side of the leading wires 5 is soldered to the circuit board 4. Since the pump device 1 according to the present embodiment is provided with four leading wires 5, as described above, there are formed four solder lands 4*a* on the upper surface of the circuit board 4. The exposed parts 30*a* contact an upper surface of the solder lands 4*a*.

Furthermore, in the circuit board 4, there are formed cutout parts 4*c* that are cut out toward an inner side of the circuit board 4 from one end surface 4*b* of the circuit board 4. The end surface 4*b* is a flat surface in parallel with the vertical direction. A clearance is formed between an inner side surface of the wall part 9*j* that faces the end surface 4*b*, and the end surface 4*b*. Moreover, the inner side surface of the wall part 9*j* that faces the end surface 4*b*, and the end surface 4*b* are in parallel to each other. The cutout parts 4*c* are formed in an entire extent in the thickness direction of the circuit board 4 (i.e., an entire extent in the vertical direction). Meanwhile, four cutout parts 4*c* are formed in the circuit board 4. The four cutout parts 4*c* are formed along the end surface 4*b*, while having a predetermined space between neighboring two of them. The cutout parts 4*c* of the present embodiment are a second cutout part.

The solder lands 4*a* are formed in the vicinity of the cutout parts 4*c*. The cutout parts 4*c* are located between the solder lands 4*a* and the end surface 4*b*. A direction, in which the four solder lands 4*a* are arranged, is consistent with a direction in which the four cutout parts 4*c* are arranged. In other words, the direction, in which the four solder lands 4*a* are arranged, is consistent with a direction coming along the end surface 4*b*. Moreover, a pitch of the four solder lands 4*a* is consistent with a pitch of the four cutout parts 4*c*.

A shape of the cutout parts 4*c* in a view from the vertical direction is rectangular. A side surface of each of the cutout parts 4*c* includes two perpendicular surfaces 4*d* that are perpendicular to the end surface 4*b*, and a connecting surface 4*e* to connect end parts of the two perpendicular surfaces 4*d* each other. The perpendicular surfaces 4*d* and the connecting surface 4*e* are individually a flat surface in parallel with the vertical direction. The connecting surface 4*e* is perpendicular to the two perpendicular surfaces 4*d*. Namely, the connecting surface 4*e* is in parallel with the end surface 4*b*.

At the cutout parts 4*c*, there are located tip parts of the sheath parts 31 including the tips 31*a* of the sheath parts 31. Concretely to describe, a lower side part of the tip parts of the sheath parts 31 is located at the cutout parts 4*c*. Moreover, at each of the four cutout parts 4*c*, there is located each of the tip parts of the sheath parts 31 of the four leading wires 5. The tips 31*a* of the sheath parts 31 individually contact the connecting surface 4*e*. Between an outer circumferential surface of the sheath parts 31 and the perpendicular surfaces 4*d*, there exists a small gap.

In the wall part 9*j*, there are shaped cutout parts 9*k* that are cut out downward from the upper end surface of the wall part 9*j*. Concretely to describe, the cutout parts 9*k* are shaped at a part in the wall part 9*j*, which faces the end surface 4*b* of the circuit board 4. Meanwhile, the cutout parts 9*k* are shaped in the vicinity of the cutout parts 4*c* in the wall part 9*j*, so that the cutout parts 9*k* are adjacent to the cutout parts 4*c*. If a part in the wall part 9*j*, at which the cutout parts 4*c* are shaped (i.e., a part facing the end surface 4*b* in the wall part 9*j*) is represented as a cutout shaping part 9*t*, the cutout shaping part 9*t* is formed so as to be a flat surface. The cutout parts 9*k* are shaped in an entire extent in a thickness direction of the cutout shaping part 9*t*.

In the present embodiment, the four cutout parts 9*k* are formed, while having a predetermined space between neighboring two of them. A direction, in which the four solder lands 4*a* are arranged, is consistent with the direction in which the four cutout parts 4*c* are arranged. Moreover, a pitch of the four cutout parts 9*k* are consistent with the pitch of the four cutout parts 4*c*, and then each of the four cutout parts 9*k* is adjacent to each of the four cutout parts 4*c*. The solder lands 4*a*, the cutout parts 4*c*, and the cutout parts 9*k* are individually arranged in a line.

If a direction perpendicular to both the thickness direction of the cutout shaping part 9*t* and the vertical direction is represented as a third direction (a direction 'W' shown in FIG. 3 through FIG. 5), a shape of the cutout parts 9*k* in a view from the thickness direction of the cutout shaping part 9*t* is a U-shape, as shown in FIG. 5, in which a width in the third direction is constant in an extent from an upper end part of the cutout shaping part 9*t* to a predetermined position in the vertical direction. Meanwhile, a cutout bottom part 9*v* as a lower end part of the cutout parts 9*k* is a concave-curved part, being semi-circular, which sags downward. A side surface of the cutout parts 9*k* (a side surface in the third direction) is a flat surface perpendicular to the third direction. As shown in FIG. 4, the cutout bottom part 9*v* is located at a position higher than the substrate contacting surface 9*n*. Moreover, a lower end of the cutout parts 9*k* is located at a position lower than a center of the circuit board 4 in the vertical direction.

In the cutout parts 9*k*, there is placed a part of the sheath parts 31. In other words, there is placed a part of the leading wires 5, in the cutout parts 9*k*. The leading wires 5 pass through the cutout parts 9*k* in such a way as to be drawn out to an outer side of the wall part 9*j*. A depth of the cutout parts 9*k* is deeper than an outer diameter position of the leading wires 5 (specifically, an outer diameter position of the sheath parts 31). As shown in FIG. 4 and FIG. 5, the leading wires 5 (specifically, the sheath parts 31) and the cutout bottom part 9*v* do not contact each other so as to be distant from each other. In other words, the cutout bottom part 9*v* and the leading wires 5 are so placed as to have a space between them in the vertical direction. Each width of the cutout parts 9*k* (in an extent excluding the cutout bottom part 9*v*) in the third direction (the direction 'W') is greater than the outer diameter of the sheath parts 31.

A part between the cutout bottom part 9*v* and the leading wires 5, is filled with an adhesive material 35. Moreover, a part of the cutout parts 9*k* over the leading wires 5, as well as a part between the side surface of the cutout parts 9*k* and the leading wires 5 are also filled with the adhesive material 35. In other words, an entire area of the cutout parts 9*k*, surrounding the leading wires 5, is filled with the adhesive material 35 (refer to FIG. 5). More specifically to describe, the entire area of the cutout parts 9*k*, surrounding the leading wires 5, is filled with the adhesive material 35 without any clearance. The leading wires 5 are fixed to the cutout shaping part 9*t* by use of the adhesive material 35. The adhesive material 35 is an adhesive material, for example, of a moisture-curable type; with which a curing process of the adhesive material starts if the adhesive material is exposed to a moisture in the air. For example, an initial curing process starts, for example, in around 40 minutes; and a full curing process finishes in around 24 hours. Viscosity of the adhesive material 35 is higher than viscosity of the potting compound 'P.'

Furthermore, at an inner side of the wall part 9*j*, the leading wires 5 are covered with the adhesive material 35. In other words, the sheath parts 31 and the exposed parts 30*a*, placed in the inner side of the wall part 9*j*, are covered with the adhesive material 35. Moreover, the solder lands 4*a* are also covered with the adhesive material 35. The sheath parts 31, placed in the inner side of the wall part 9*j*, are fixed to an end part of the circuit board 4 by use of the adhesive material 35. In other words, the leading wires 5 are fixed by use of adhesive, to the end part of the circuit board 4. Incidentally, the adhesive material 35 is not illustrated in FIG. 1 and FIG. 2.

In the present embodiment; after soldering the leading wires 5 to the circuit board 4, the circuit board 4 is mounted onto the substrate contacting surface 9*n* of the motor case 9 to which the stator 7 is already installed; and meanwhile, the part of the leading wires 5 is placed into the cutout parts 9*k*. Before mounting the circuit board 4 onto the substrate contacting surface 9*n*, the adhesive material 35 is applied to the cutout parts 9*k*. Concretely to describe, the adhesive material 35 is applied to the cutout parts 9*k* in such a way that an upper surface of the adhesive material 35 becomes higher than a placement level designed for a center of the leading wires 5. In the present embodiment, the adhesive material 35 prior to a curing process is applied to a whole part of the cutout parts 9*k*. The part of the leading wires 5 is placed into the cutout parts 9*k* that is already filled with the adhesive material 35 prior to the curing process. In other words, the part of the leading wires 5 is inserted into the cutout parts 9*k* from an upper side, in such a way as to be buried in the adhesive material 35 prior to the curing process.

Then, in a situation of being pressed against the substrate contacting surface 9*n*, the circuit board 4 is fixed to the motor case 9, by way of melting the upper end part of the protrusions 9*h*. Subsequently, the adhesive material 35 is applied from an upper side to the leading wires 5 and the like, which are placed in the inner side of the wall part 9*j*, in such a way as to cover the leading wires 5 and the like by use of the adhesive material 35. Furthermore, in order to fill up the entire area of the cutout parts 9*k* with the adhesive material 35, without any clearance, the adhesive material 35 is replenished to an upper side part of the leading wires 5 in the cutout parts 9*k*. Then, after curing the adhesive material 35, the potting compound 'P' is filled so as to cover the circuit board 4 and the stator 7 with the potting compound 'P.' At this time, though it is preferable to fill with the potting compound 'P' after the adhesive material 35 is fully cured, the potting compound 'P' may be filled after the adhesive material 35 is only initially cured.

(Primary Advantageous Effect of the Present Embodiment)

As explained above, in the present embodiment; the leading wires 5 soldered to the circuit board 4 are drawn out of the circuit board 4. Moreover, according to the present embodiment; at the wall part 9*j* of the pump case 8 surrounding the circuit board 4, there are shaped the cutout parts 9*k* that are cut out downward from the upper end surface of the wall part 9*j*, and the leading wires 5 pass through the cutout parts 9*k* in such a way as to be drawn out to the outer side of the wall part 9*j*. Accordingly, in comparison to a case where a connector is mounted on the circuit board 4, it becomes possible according to the present embodiment to control an amount of the leading wires 5 protruding out of the upper surface of the circuit board 4. Therefore, in comparison to the case where the connector is mounted on the circuit board 4, it becomes possible according to the present embodiment to make the pump device 1 low-profile in the vertical direction.

Furthermore, according to the present embodiment; in the circuit board 4, being plane-like and placed in such a way that the thickness direction of the circuit board 4 is consistent with the vertical direction, there are formed cutout parts 4*c* that are cut out toward the inner side of the circuit board 4 from the end surface 4*b* of the circuit board 4; and the tip parts of the sheath parts 31 of the leading wires 5 are located at the cutout parts 4*c*. Accordingly, it becomes possible according to the present embodiment to control an amount of the sheath parts 31 protruding out of the upper surface of the circuit board 4. Therefore, according to the present embodiment, even though a height of the wall part 9*j* surrounding the circuit board 4 is made low, it is possible to prevent the leading wires 5 from interfering with the cover 27 so that the pump device 1 can be made to be low-profile in the vertical direction.

In the present embodiment, the cutout bottom part 9*v* as the lower end part of the cutout parts 9*k*, and the leading wires 5 do not contact each other so as to be detached from each other. Therefore, according to the present embodiment; at the time when the circuit board 4, to which the leading wires 5 are soldered, is fixed to the motor case 9, by way of melting the upper end part of the protrusions 9*h*, in a situation where the circuit board 4 is pressed against the substrate contacting surface 9*n*, it becomes possible to prevent an excessive force from acting on the exposed parts 30*a* soldered and fixed to the solder lands 4*a*. Therefore, according to the present embodiment; even at the time when the circuit board 4, to which the leading wires 5 are soldered, is fixed to the motor case 9 by way of deposit-welding, in the situation where the circuit board 4 is pressed against the substrate contacting surface 9*n*, it becomes possible to protect the exposed parts 30*a* against being removed from the circuit board 4, owing to fixing work of the circuit board 4.

In the present embodiment, the part between the cutout bottom part 9*v* and the leading wires 5, is filled with an adhesive material 35. Therefore, according to the present embodiment; even though the cutout bottom part 9*v* and the leading wires 5 do not contact each other so as to be detached from each other; at the time of filling with the potting compound 'P' in such a way as to cover the circuit board 4 and the stator 7, it becomes possible by use of the adhesive material 35 filled at the part between the cutout bottom part 9*v* and the leading wires 5, to prevent the potting compound 'P' from escaping through the part between the cutout bottom part 9*v* and the leading wires 5 to the outer side of the wall part 9*j*. Moreover, according to the present embodiment; since the entire area of the cutout parts 9*k* is filled with the adhesive material 35 in such a way as to surround the leading wires 5; even though the cutout parts 9*k* are shaped at the wall part 9*j*, it becomes possible at the time of filling with the potting compound 'P' to prevent the potting compound 'P' from escaping through the cutout parts 9*k* to the outer side of the wall part 9*j*.

In the present embodiment, the cutout bottom part 9*v* is located at the position higher than the substrate contacting surface 9*n*. Therefore, in the present embodiment, it is possible to prevent a clearance in the vertical direction between the cutout bottom part 9*v* and the leading wires 5 from unnecessarily becoming wide. Therefore, according to the present embodiment; the amount of the adhesive material 35, to be filled at the clearance between the cutout bottom part 9*v* and the leading wires 5, can be reduced so that it becomes possible to shorten a curing time of the adhesive material 35, filled at the clearance between the cutout bottom part 9*v* and the leading wires 5.

Furthermore, if a clearance in the vertical direction is unnecessarily wide between the cutout bottom part 9*v* and the leading wires 5, the adhesive material 35 applied between the cutout bottom part 9*v* and the leading wires 5 is likely to escape through the clearance between the cutout bottom part 9*v* and the leading wires 5. Nevertheless, according to the present embodiment, it is possible to prevent the clearance in the vertical direction between the cutout bottom part 9*v* and the leading wires 5 from unnecessarily becoming wide so that the adhesive material 35 applied between the cutout bottom part 9*v* and the leading wires 5 is unlikely to escape through the clearance between the cutout bottom part 9*v* and the leading wires 5.

In the present embodiment, the leading wires 5 are fixed by use of adhesive, to the end part of the circuit board 4. Therefore, according to the present embodiment, it is possible to prevent an excessive force from acting on the exposed parts 30*a* soldered to the solder lands 4*a*.

(Variations with Respect to the Cutout Parts)

FIG. 6 through FIG. 9B are diagrams for explaining a structure of the cutout parts 9*k* relating to other embodiments according to the present invention.

Figure 6:
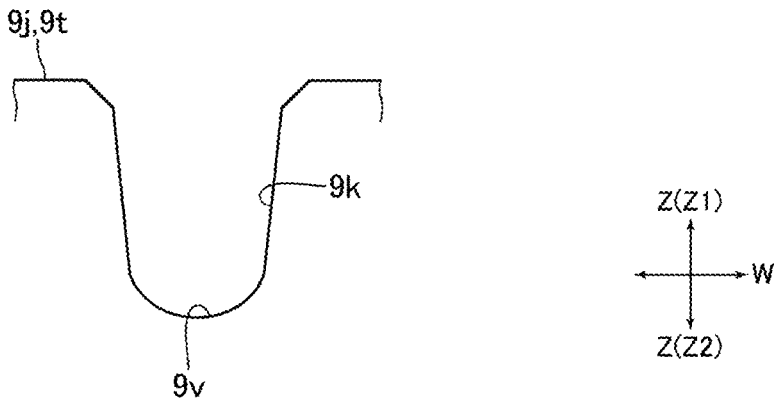
FIG. 6 is a diagram for explaining a structure of a cutout part relating to another embodiment according to the present invention.

In the embodiment described above, a shape of the cutout parts 9*k* in a view from the thickness direction of the cutout shaping part 9*t* may be a different shape other than the U-shape. For example, the shape of the cutout parts 9*k* in the view from the thickness direction of the cutout shaping part 9*t* may be a semi-conical form, as shown in FIG. 6, in which a width in the third direction (the direction 'W') gradually becomes narrower as a width position comes down from the upper end part of the cutout shaping part 9*t*.

In this case; in comparison to the case where the shape of the cutout parts 9*k* in the view from the thickness direction of the cutout shaping part 9*t* is a U-shape, the amount of adhesive material 35, to be filled at the clearance between the cutout bottom part 9*v* and the leading wires 5, can be reduced. Therefore, it becomes possible to shorten a curing time of the adhesive material 35, to be filled at the clearance between the cutout bottom part 9*v* and the leading wires 5. Furthermore, the shape of the cutout parts 9*k* in the view from the thickness direction of the cutout shaping part 9*t* may also be rectangular.

Figure 7A:
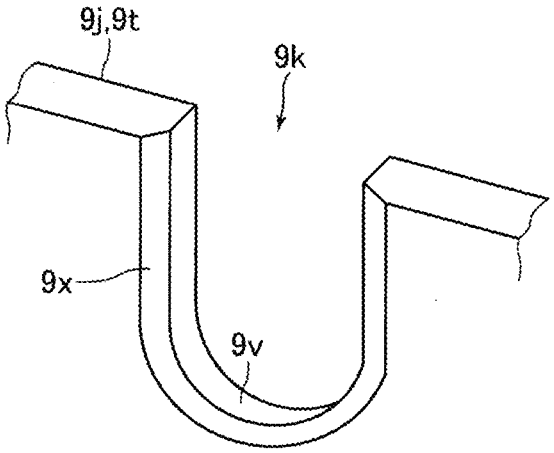
FIG. 7A and FIG. 7B is a diagram for explaining a structure of a cutout part relating to another embodiment according to the present invention; the diagram including FIG. 7A that is a perspective view, and FIG. 7B that is a plan view.
Figure 7B:
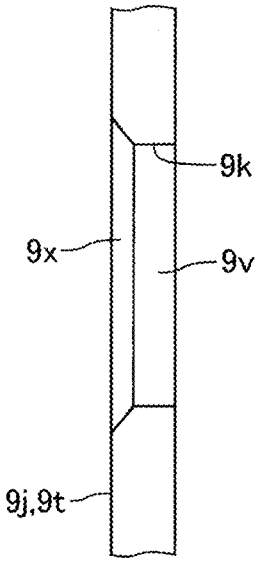

In the embodiment described above, at an edge of the cutout parts 9*k* of the inner side surface of the wall part 9*j* (namely, an inner side surface of the cutout shaping part 9*t*), there may be shaped a sloped surface 9*x* (a tapered surface) that is sloped so as to be further away from the cutout parts 9*k* as a slope position comes toward the inner side of the wall part 9*j*, as shown in FIG. 7A and FIG. 7B. In this case, the adhesive material 35 filled in the cutout parts 9*k* and the adhesive material 35 covering the leading wires 5 and the like, in the inner side of the wall part 9*j*, are unlikely to escape into the outer side of the wall part 9*j*.

Figure 8A:
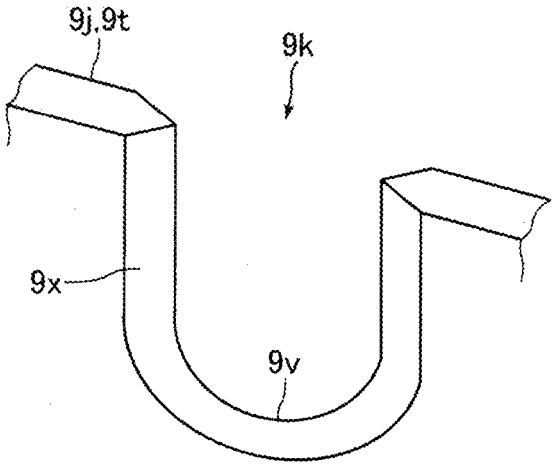
FIG. 8A and FIG. 8B is a diagram for explaining a structure of a cutout part relating to still another embodiment according to the present invention; the diagram including FIG. 8A that is a perspective view, and FIG. 8B that is a plan view.
Figure 8B:
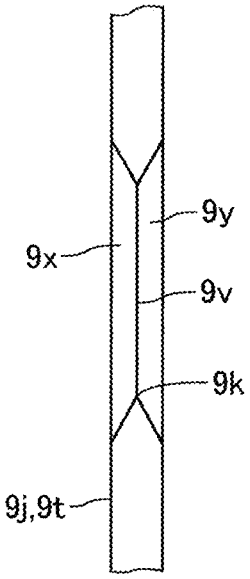

Furthermore, at an edge of the cutout parts 9*k* of an outer side surface of the wall part 9*j* (namely, an outer side surface of the cutout shaping part 9*t*), there may be shaped a sloped surface 9*y* (a tapered surface), as a second sloped surface in addition to the sloped surface 9*x*; the sloped surface 9*y* being sloped so as to be further away from the cutout parts 9*k* as a slope position comes toward the outer side of the wall part 9*j*, as shown in FIG. 8A and FIG. 8B. In this case, since a thickness of the cutout parts 9*k* becomes thinner in the thickness direction of the cutout shaping part 9*t*, the adhesive material 35 filled in the cutout parts 9*k* is unlikely to escape from the cutout parts 9*k*, owing to surface tension. Therefore, the adhesive material 35 filled in the cutout parts 9*k* is more unlikely to escape into the outer side of the wall part 9*j*.

Figure 9A:
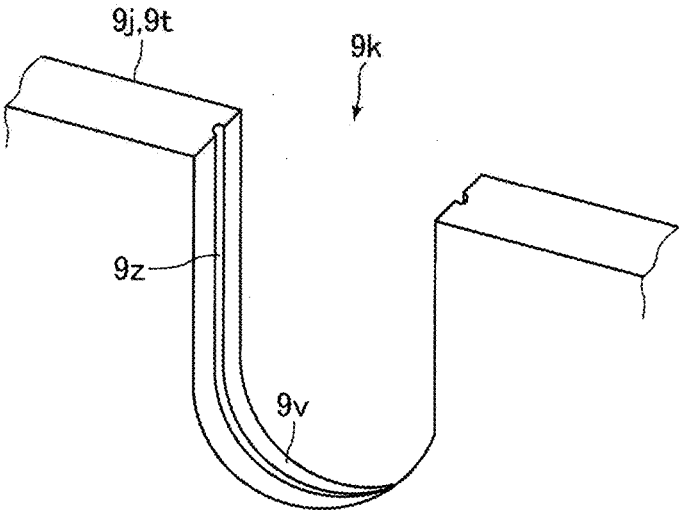
FIG. 9A and FIG. 9B is a diagram for explaining a structure of a cutout part relating to still another embodiment according to the present invention; the diagram including FIG. 9A that is a perspective view, and FIG. 9B that is a plan view.
Figure 9B:
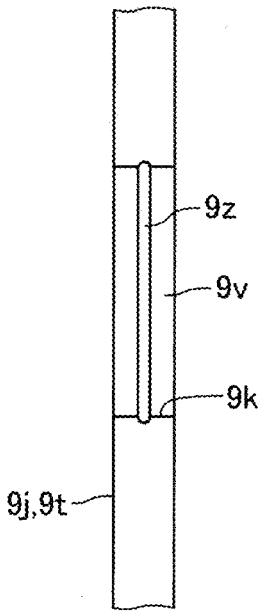

In the embodiment described above; at the cutout parts 9*k*, there may be shaped a concave part 9*z* where a part of the adhesive material 35 is held, as shown in FIG. 9A and FIG. 9B. The concave part 9*z* is shaped, for example, so as to be a groove that is continuously connected through all parts including side surfaces (side surfaces in the third direction) of the cutout parts 9*k* and the cutout bottom part 9*v*. In this case, the adhesive material 35 filled in the cutout parts 9*k* is unlikely to escape from the cutout parts 9*k*.

Other Embodiments

Described above is an example of a preferred embodiment according to the present invention; and the present invention is not limited to the above embodiment, and various variations and modifications may be made without changing the concept of the present invention.

In the embodiment described above; as far as it is possible to prevent the potting compound 'P' from escaping through the cutout parts 9*k* to the outer side of the wall part 9*j*, there may exist some part having no adhesive material 35 filled, in the cutout parts 9*k*. Moreover, in the embodiment described above; the circuit board 4 may be fixed to the motor case 9, by way of a fixing method other than the method of deposit-welding. For example, the circuit board 4 may be fixed to the motor case 9, by use of a screw. Furthermore, in the embodiment described above; the cutout bottom part 9*v* may be placed at a side lower than the substrate contacting surface 9*n*, and may also be placed at the same position as the substrate contacting surface 9*n* in the vertical direction.

In the embodiment described above, the exposed parts 30*a* may not be covered with the adhesive material 35. Moreover, in the embodiment described above; the sheath parts 31 and the exposed parts 30*a*, which are placed in the inner side of the wall part 9*j*, may not be covered with the adhesive material 35. In other words, the leading wires 5 may not be fixed by use of adhesive, to the end part of the circuit board 4. Furthermore, in the embodiment described above; the shape of the cutout parts 4*c* in a view from the vertical direction may be a shape other than a rectangle. Still further, in the embodiment described above; there are no cutout parts 4*c* shaped in the circuit board 4.

In the embodiment described above, the number of the leading wires 5 provided for the pump device 1 may be one, two, or three, and may also be five or more. In such a case, the solder lands 4*a*, the cutout parts 4*c*, and the cutout parts 9*k* are shaped in response to the number of the leading wires 5. Moreover, in the embodiment described above, the motor 2 may be provided with a rotary shaft instead of the fixed shaft 18, the impeller 3 being fixed to the rotary shaft. The rotary shaft in this case is a rotation center axis that serves as the rotation center of the impeller 3 and the rotor 6. Furthermore, in the embodiment described above, the motor 2 may be a motor of an inner-rotor type.

| [Reference Numerals] | |
|---|---|
| 1. | pump device |
| 2. | motor |
| 3. | impeller |
| 4. | circuit board |
| 4a. | solder lands |
| 4c. | cutout parts (second cutout part) |
| 4f. | through hole |
| 5. | leading wires |
| 6. | rotor |
| 7. | stator |
| 8. | pump case |
| 9h. | protrusions |
| 9j. | wall part |
| 9k. | cutout parts |

-continued

| [Reference Numerals] | |
|---|---|
| 9n. | substrate contacting surface |
| 9r. | deposit-welded part |
| 9t. | cutout shaping part |
| 9v. | cutout bottom part |
| 9x. | sloped surface |
| 9y. | sloped surface (second sloped surface) |
| 9z. | concave part |
| 10a. | suction port |
| 10b. | discharge port |
| 11. | pump chamber |
| 18. | fixed shaft (turning center shaft) |
| 30. | cable cores |
| 30a. | exposed parts |
| 31. | sheath parts |
| 31a. | tips of the sheath parts |
| 35. | adhesive material |
| 'P' | potting compound |
| 'W' | third direction |
| 'Z' | axial direction of turning center shaft (vertical direction) |
| 'Z1' | second direction |
| 'Z2' | first direction |

What is claimed is:

1. A pump device comprising:

a motor having a rotor and a stator;

an impeller that is fixed to the rotor, and turns by use of drive power of the motor;

a circuit board for controlling the motor; and a leading wire whose one end side is soldered to the circuit board, and the leading wire being drawn out of the circuit board;

wherein, inside a pump case in which the rotor, the stator, the circuit board and the impeller are housed, there is formed a pump chamber through which liquid sucked from a suction port passes toward a discharge port;

if one side in an axial direction of a turning center shaft, as a turning center of the rotor and the impeller, is represented as a first direction, and an opposite direction to the first direction is represented as a second direction;

the impeller is fixed to the rotor at a side of the first direction, and the circuit board is a rigid substrate, and placed at a side of the second direction of the stator;

a thickness direction of the circuit board is consistent with the axial direction of the turning center shaft;

in the pump case, there are formed a wall part surrounding the circuit board, a substrate contacting surface contacting a surface of the circuit board at a side of the first direction in order to locate the circuit board in the axial direction of the turning center shaft, and a protrusion formed so as to protrude from the substrate contacting surface to a side of the second direction;

in the wall part, there is shaped a cutout part in which a part of the leading wire is placed, the cutout part being cut out in the wall part from an end surface at a side of the second direction toward a side of the first direction;

the leading wire passes through the cutout part in such a way as to be drawn out to an outer side of the wall part;

in the circuit board, there is formed a through hole through which the protrusion protruded from the substrate contacting surface is inserted;

at a tip part of the protrusion, there is formed a deposit-welded part that prevents the circuit board from coming off to the side of the second direction in a situation where the circuit board, to which the leading wire is soldered, is pressed against the substrate contacting surface, and in the situation that the circuit board is pressed against the substrate contacting surface, a cutout bottom part which is an end part of the cutout part at a side of the first direction, and the leading wire do not contact each other so as to be detached from each other and a side of the first direction of the leading wire does not contact the cutout bottom part.

2. The pump device according to claim 1;

where, the rotor and the impeller are placed inside the pump chamber;

the stator and the circuit board are placed outside the pump chamber;

an area inside the pump case, where the stator and the circuit board are placed outside the pump chamber, is filled with a potting compound; and at least, a part between the cutout bottom part and the leading wire, is filled with an adhesive material.

3. The pump device according to claim 2;

where, an entire area of the cutout part is filled with the adhesive material in such a way as to surround the leading wire.

4. The pump device according to claim 3;

where, the cutout bottom part is located at a side of the second direction, in comparison to the substrate contacting surface.

5. The pump device according to claim 1;

where, the leading wire is fixed by use of adhesive, to an end part of the circuit board.

6. The pump device according to claim 1;

where, the leading wire includes a plurality of cable cores made of a conductive material, and a sheath part made of an insulative material, for individually covering around each of the plurality of cable cores;

a tip part of each of the plurality of cable cores is an exposed part that exposes itself by way of protruding out of a tip of the sheath part;

in the circuit board, there is formed a second cutout part that is cut out toward an inner side of the circuit board from an end surface of the circuit board;

in the vicinity of the second cutout part, on a surface of the circuit board at a side of the second direction, there is formed a solder land where the exposed part is soldered so as to be fixed; and at the second cutout part, there is located a tip part of the sheath part including the tip of the sheath part.

7. The pump device according to claim 1;

where, if a part in the wall part, at which the cutout part is shaped, is dealt with as a cutout shaping part, and a direction perpendicular to the axial direction of the turning center shaft as well as a thickness direction of the cutout shaping part is represented as a third direction, a shape of the cutout part in a view from the thickness direction of the cutout shaping part is either a U-shape, in which a width in the third direction is constant in an extent from an end part at a side of the second direction of the cutout shaping part to a predetermined position in the axial direction of the turning center shaft, or a semi-conical form, in which a width in the third direction gradually becomes narrower as a width position comes from the end part at the side of the second direction of the cutout shaping part toward the side of the first direction.

8. The pump device according to claim 2;

wherein, at an edge of the cutout part of an inner side surface of the wall part, there is shaped a sloped surface that is sloped so as to be further away from the cutout part as a slope position comes toward an inner side of the wall part.

9. The pump device according to claim 8;

wherein, at an edge of the cutout part of an outer side surface of the wall part, there is shaped a second sloped surface that is sloped so as to be further away from the cutout part as a slope position comes toward the outer side of the wall part.

10. The pump device according to claim 2;

wherein, at the cutout part, there is shaped a concave part where a part of the adhesive material is held.

11. The pump device according to claim 2;

where, the cutout bottom part is placed at a side of the second direction, in comparison to the substrate contacting surface.

* * * * *